US006041854A

United States Patent [19]

Fox

[11] Patent Number: 6,041,854

[45] Date of Patent: Mar. 28, 2000

[54] WATER COOLED PANEL

[75] Inventor: Peter Fox, Sheffield, United Kingdom

[73] Assignee: P. Howard Industrial Pipework Services Ltd., Sheffield, United Kingdom

[21] Appl. No.: 09/146,267

[22] Filed: Sep. 3, 1998

[30] Foreign Application Priority Data

| | | | |
|---|---|---|---|
| Sep. 30, 1997 | [GB] | United Kingdom | 9720608 |
| Mar. 12, 1998 | [GB] | United Kingdom | 9805156 |

[51] Int. Cl.[7] ..... F28F 3/12

[52] U.S. Cl. ..... 165/168; 165/169; 122/6 A

[58] Field of Search ..... 165/168, 169, 165/170, 171; 122/6 A, 510

[56] References Cited

U.S. PATENT DOCUMENTS

| | | | |
|---|---|---|---|
| 1,774,150 | 8/1930 | Murray | 122/6 A |
| 1,991,631 | 2/1935 | Sangster | 165/168 |
| 2,089,000 | 8/1937 | Murray, Jr. | 122/6 A |
| 2,304,788 | 12/1942 | Bailey | 165/168 |
| 2,602,648 | 7/1952 | Martel | 165/168 |
| 2,705,476 | 4/1955 | Hardgrove | 122/6 A |
| 3,554,276 | 1/1971 | Stallkamp | 165/168 |
| 4,123,994 | 11/1978 | Gersch et al. | 122/6 A |
| 4,188,915 | 2/1980 | Kummel et al. | 122/6 A |
| 4,347,810 | 9/1982 | Rees | 122/6 A |
| 4,598,667 | 7/1986 | Kuhlmann et al. | 122/6 A |
| 4,903,640 | 2/1990 | Howard | 165/168 |
| 4,966,100 | 10/1990 | Fournier et al. | 122/6 A |
| 4,977,955 | 12/1990 | Schweizer | 165/168 |
| 5,799,723 | 9/1998 | Sokolean | 165/168 |

FOREIGN PATENT DOCUMENTS

| | | | |
|---|---|---|---|
| 2482881 | 11/1981 | France | 165/168 |
| 276013 | 6/1926 | Germany | 165/168 |
| 861537 | 1/1953 | Germany | 165/169 |
| 2939076 | 4/1981 | Germany | 165/169 |
| 428030 | 8/1950 | Italy | 165/168 |
| 1686295 | 10/1991 | U.S.S.R. | 165/168 |

*Primary Examiner*—Ira S. Lazarus
*Assistant Examiner*—Terrell McKinnon
*Attorney, Agent, or Firm*—Trexler, Bushnell, Giangiorgi & Blackstone, Ltd.

[57] ABSTRACT

A water cooled panel (1), e.g. for metallurgical use, is constructed from a plurality of rectangular hollow section tube lengths (2), with adjacent tube lengths oriented corner-to-corner in a diamond array, with geometrical diagonals (4) of the tubes in a common plane (5), or generally so, and with means (6, 7, 12) to secure the tubes in such orientation, and with means (14–20) to ensure water flow communication between an end portion of one tube length (2) and an end portion of an adjacent tube length (2).

18 Claims, 4 Drawing Sheets

WATER COOLED PANEL

FIELD OF INVENTION

This invention relates to a water cooled panel adapted for instance to form part of a furnace, typically an electric arc furnace, as part of the furnace wall, roof tunnel etc., or to constitute ancillary equipment of such a ladle roof.

DESCRIPTION OF PRIOR ART

In GB 2198826 is described a panel constructed from a plurality of hollow section, water conveying tube lengths of mild steel which are welded together to form a panel of required shape and dimensions. Such panels have proved in practice to provide exceptional service in terms of freedom from maintenance, reliability, and lifespan.

However, for metallurgical furnace installations, to achieve slag pick-up by such panels from the surface of a melt, resulting in advantageous heat flux decay due to the presence of the slag, it is usually necessary to provide on the "hot" face of the panel a series of so-called slag catchers, which are metallic stalks or shelves, adapted to encourage the slag pick-up, and to propagate the collection of slag, and whilst such slag catchers are operationally satisfactory they are not, unlike the remainder of the panel, water-cooled, and consequently at operational temperatures of say 230° C., cracks have been known to form in the zones where the slag catchers are welded to the "hot" face of the panel.

Furthermore, prior art panels in accordance with GB 21998826 have a cooling effect dependent basically upon the surface area of the panel presented to the furnace and the rate of flow of cooling water through the panel, and whilst the former factor is of course finite, limitations are also placed upon maximum water flow resulting from the water-conveying cross-section of the tube lengths as well as pump and reservoir capacities.

OBJECT OF THE INVENTION

A basic object of the present invention is to provide an improved panel, which in certain operational circumstances, has advantages beyond these afforded by GB 2198826.

SUMMARY OF THE INVENTION

According to a first aspect of the present invention there is provided a panel, adapted, in use, to be water cooled, constructed from a plurality of hollow section tube lengths of rectangular cross-section, with adjacent tube lengths oriented corner-to-corner in a diamond array, with geometrical diagonals across the corners of the tube lengths in a common plane, or generally so, and with means to secure the tube lengths in such orientation, and with means to ensure water flow communication between an end portion of one tube length and an end portion of an adjacent tube length.

Thus, the resulting non-planar "hot" face of the panel, whereby the "hot" face of the panel is defined by 45° walls of the tube lengths and an interposed 90° corner, results in some walls encouraging (in the case of metallurgical use of the panel) slag pick-up, thereby constituting slag pick-up areas. However, slag pick-up can be enhanced with the attachment of slag catchers. Furthermore, the diamond array of the tube lengths of the panel results in a greater surface area being presented to e.g. a furnace, for greater cooling effect than is possible with a planar panel, all other factors being the same.

Preferably, the tube lengths are of mild steel, which is preferably hot finished. The means to secure the tube lengths in the orientation required, is preferably weld metal, although formation of at least a part of the panel from copper tube lengths is not precluded.

In principle, the adjacent, external top and bottom corners of the tube lengths may be butted together or may be spaced by a relatively small gap, e.g. <20 mm, with weld metal located at the base of the resulting "V"-grooves on both sides of the panel, i.e. on the intended "hot" face, and on the intended "cold" face of the panel. The weld metal may be continuous, or space welding may be effected.

As an alternative to welding together adjacent tube lengths, the tube lengths may be welded to a common, "cold" side, backing plate, conveniently by welding "cold" corners to the backing plate, preferably at slots cut into the backing plate and serving both for welding and for tube length location. Again, adjacent corners of adjacent tube lengths may be butted together, or may be spaced by a relatively small gap, e.g. <20 mm.

For a panel intended to form part of a furnace wall, the tube lengths are preferably arranged in a parallel array, either horizontally or vertically. The tube lengths may be straight, to produce a flat panel, or may be curved, to produce a curved panel, as would be required for a wall of a conventionally circular-in-plan electric arc furnace. Thus, if a panel subtended an arc of 30°, then twelve such panels would be required in order to form a complete wall. Furthermore, instead of being curved in one plane, the panel may be curved in two planes, as might be required if the panel were to form part of a furnace roof. The panels may be rectangular, segmental, or circular (flat, convex or frusto-conical) depending on their intended installation.

Preferably, the panel, of whatever configuration, is provided, along one side, with a water inlet tube length extending orthogonally or generally so, (with respect to the longitudinal axes of the tube lengths of a rectangular panel) or radially (in the case of a segmental panel). Thus, for a furnace wall panel with horizontal tube lengths, the water inlet tube length extends vertically (when the panel is assembled into a furnace), with water flow being down the inlet tube length, into the lowermost tube length and then in a zig-zag route successfully through the stack of tube lengths of the panel, until water exits from an exit aperture in the uppermost tube length.

To provide for inlet and outlet of water from the panel, the uppermost tube length (in the case of a panel intended to be used in a vertical plane) or the radially outermost tube length (in the case of a segmental panel) is divided at approximately its mid-length into two halves, with one half provided with a water inlet port and the other half with a water outlet port, and with the water inlet half in water flow communication with the water inlet tube, and with the outlet half in water flow communication with the last of the tube lengths.

Furthermore, the upper end of a panel intended for use in a vertical plane, may be provided with two spaced-apart plates extending the full length of the panel, the underside of the upper plate being welded to the top corner of the divided tube length and the bottom plate being welded to the cold corners of the next tube length down.

The upper plate may be two lifting holes whereby the panel may be craned in and craned out of its required location, whilst the lower plate may be provided with locating holes.

Slag catchers, if provided, may simply take the form of metallic stalks or plates, typically of mild steel, and may be located at regularly spaced locations along each tube length, and preferably staggered with respect to the slag catchers of an adjacent tube length.

According to a second aspect of the invention there is provided an electric arc furnace incorporating as its wall, or part of its wall, and/or its roof, or part of its roof, at least one panel in accordance with the first aspect.

According to a third aspect of the invention there is provided a ladle incorporating as its roof a panel in accordance with the first aspect.

BRIEF DESCRIPTION OF THE DRAWINGS

Two embodiments of the panel in accordance with the invention will now be described in greater detail, by way of example, with reference to the accompanying drawings, in which.

In all Figures, like components are accorded like reference numerals.

DETAILED DESCRIPTION OF THE DRAWINGS

Figure 1:
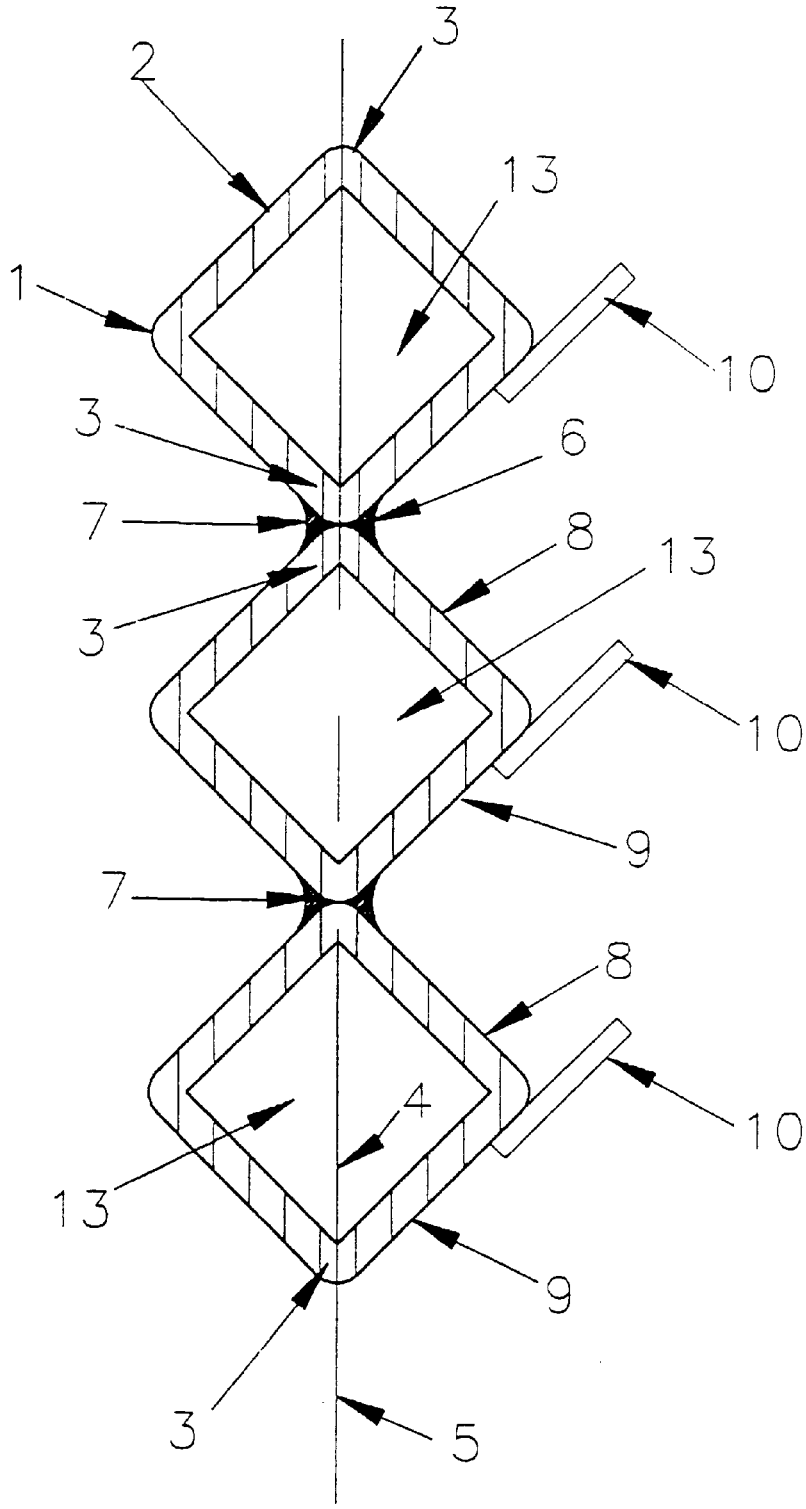
- FIG. 1 is a longitudinal sectional view through a portion of a first embodiment of panel.

A water cooled panel 1 is constructed from a plurality of parallel tube lengths 2 of rectangular hollow section mild steel and thereby having four corners 3. Adjacent tube lengths 2 are oriented on their top and bottom corner 3, in a diamond array, with geometrical diagonals 4 of the tubes in a common plane 5, which, in the case of a furnace panel, is upright. In the embodiment of FIG. 1 the corners 3 are butted together and adjacent tube lengths 2 are secured by weld metal 6 at a "hot" face of the panel, and weld metal 7 at a "cold" face of the panel, resulting in the "hot" face of the panel being defined by two 45° walls 8, 9, of the panel and an interconnecting "hot" corner 3. The walls 8 encourage slag pick-up thereon. For enhanced slag pick-up, a plurality of slag catchers 10 are welded to portions of the tube lengths 2 at the "hot" face of the panel. Clearly, the panel is constructed to required overall dimensions by employing an appropriate number of tube lengths 2 to create a panel of required height, with the tube lengths 2 being of length dependent upon that required for the panel.

Figure 2:
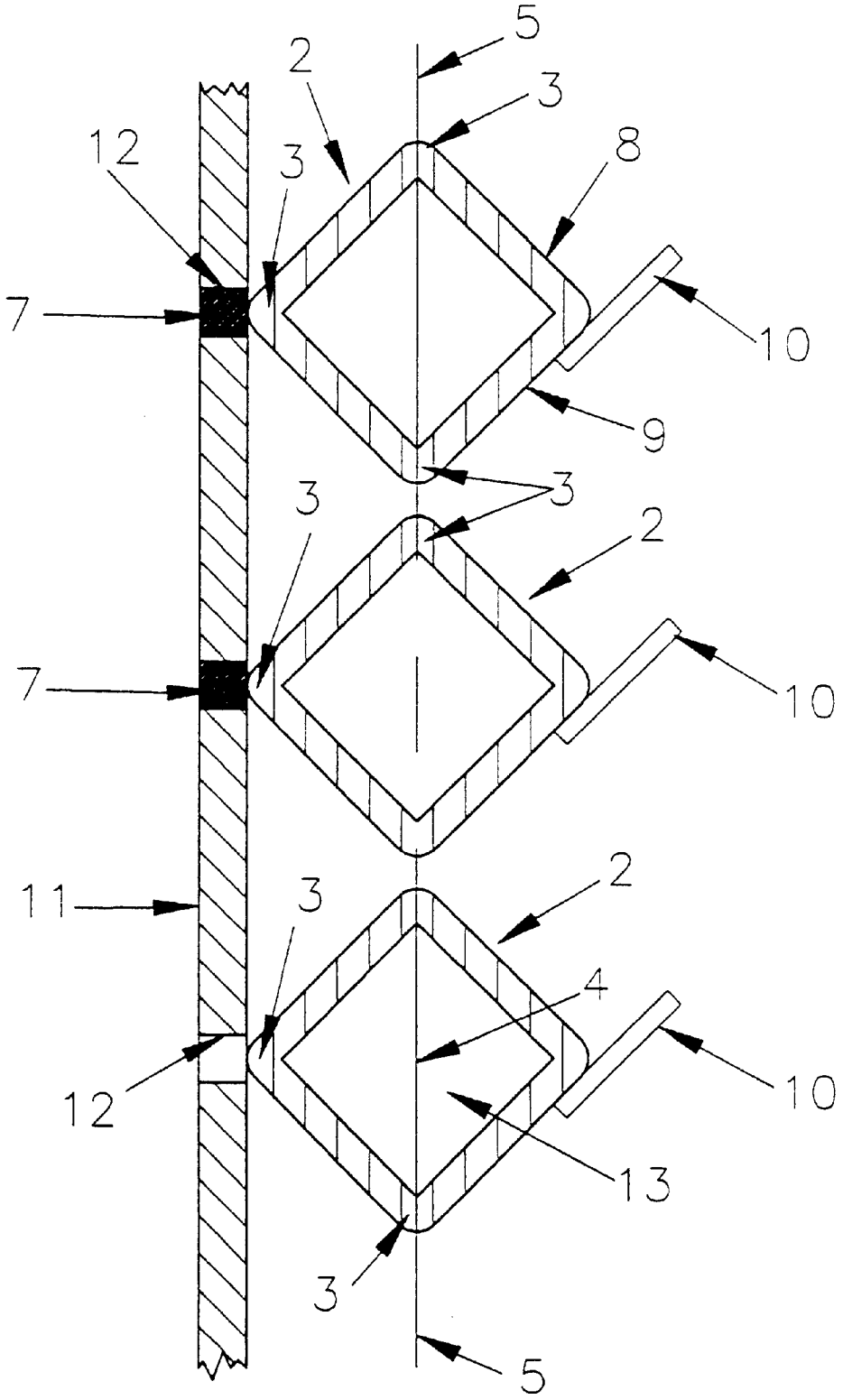
FIG. 2 is a longitudinal sectional view through a portion of a second embodiment of panel.

In the embodiment of FIG. 2, adjacent tube lengths 2 are welded to a backing plate 11 which, for the purpose, is provided with a plurality of slots 12 which enable a "cold" corner 3 of each tube length 2 to be located therein, thereby ensuring correct positioning of the tube lengths 2 with respect to the backing plate 11, for the tube lengths 2 to be secured by weld metal 7. Also in this embodiment, the top and bottom corners 3 are not butted together but are located with slight spacing of up to 20 mm. Again, slag catchers 10 may be provided on the "hot" face of the panel 1.

The panels 1 are cooled by water flow, e.g. at 100 gallons per minute, along the interiors 13 of the tube lengths 2, with the water following a zig-zag flow path firstly into and along a lowermost tube length 2 and then into the adjacent upper tube length 2 etc., until water exits from the uppermost tube length 2 to flow to reservoir etc., and various proposals are shown in FIGS. 3*a* to 6*b* for achieving water flow communication and flow direction reversal between adjacent tube lengths 2.

Figures 3A, 3B, 4A, 4B, 5A, 5B, 6A, 6B:
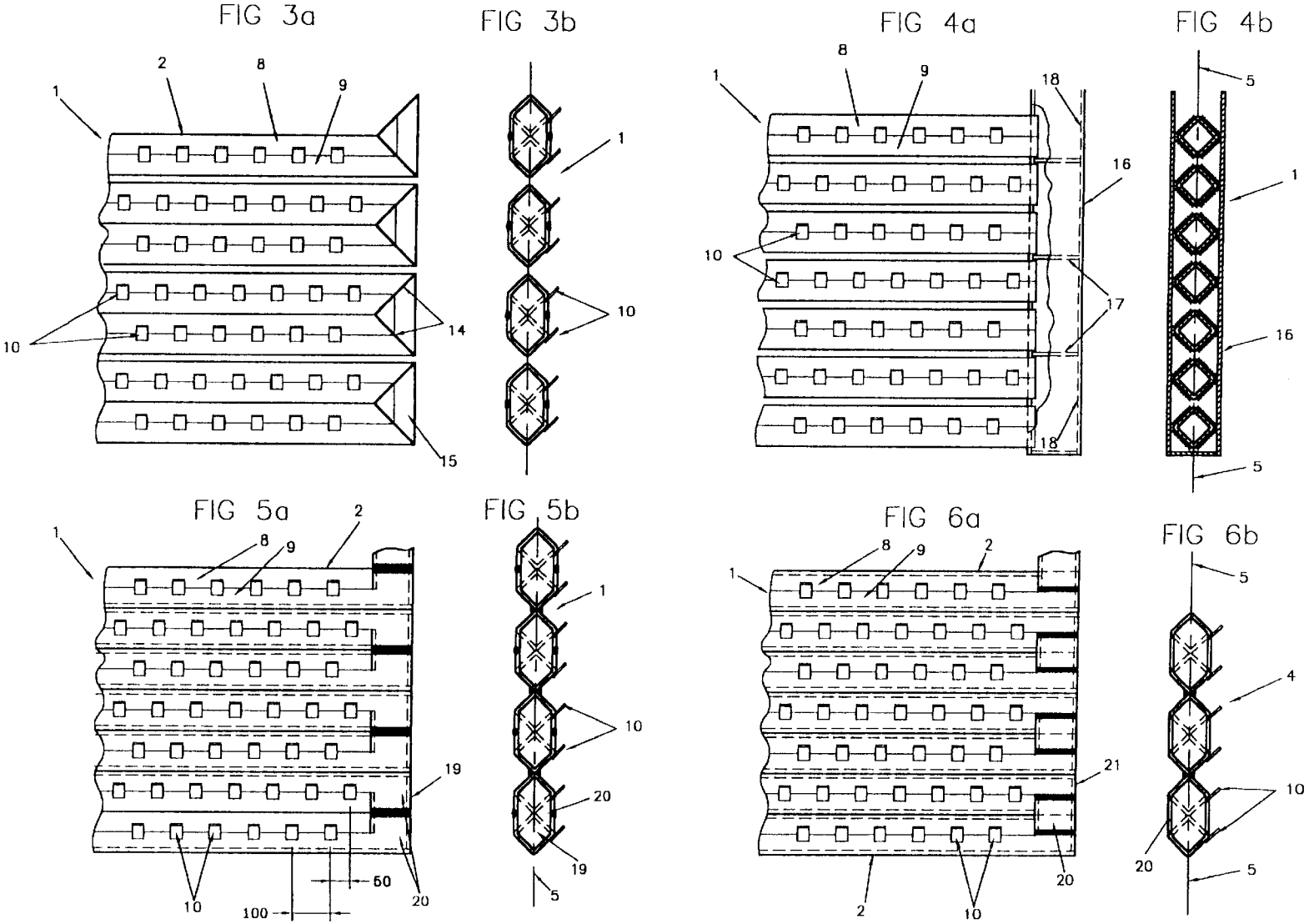
FIGS. 3*a* and 3*b*, 4*a* and 4*b*, 5*a* and 5*b*, and 6*a* and 6*b* are respectively front elevations and sectional views through four embodiments of panel, showing various alternative possibilities for return bends.

In detail, in the panel embodiment of FIGS. 3*a* and 3*b*, the tube lengths 2 are both butted and slightly spaced (as in the FIG. 1 and FIG. 2 embodiments respectively) and ends 14 of the tube lengths 2 are open and angled at 45° so that a generally triangular insert 15 may be welded as a mitred fit across the ends to constitute a return chamber having an hexagonal end configuration for reversing the direction of water flow. FIG. 3*a* also indicates the staggering of slag catchers 10 between adjacent tube lengths 2.

In the embodiment of FIGS. 4*a* and 4*b*, adjacent tube lengths 2 are all spaced apart (as in the FIG. 2 embodiment), with the ends of the tube lengths 2 open, inset and welded into a box section structure 16 separated by plates 17 into individual water return chambers 18 communicating between the open ends of adjacent tube lengths.

In the embodiments of FIGS. 5*a* and 5*b*, the tube lengths 2 are butted and welded together (as in the embodiment of FIG. 1), and the ends of the tube lengths 2 are closed off by a plate 19 forming part of a return chamber 20 common to adjacent tube lengths 2 and also having an hexagonal end configuration.

In the embodiment of FIGS. 6*a* and 6*b*, the tube lengths are again butted and welded (as in the FIG. 1 embodiment), and the ends of the tube lengths 2 are closed off by a plate 21 forming part of similar water return chamber 20.

Figure 7B:
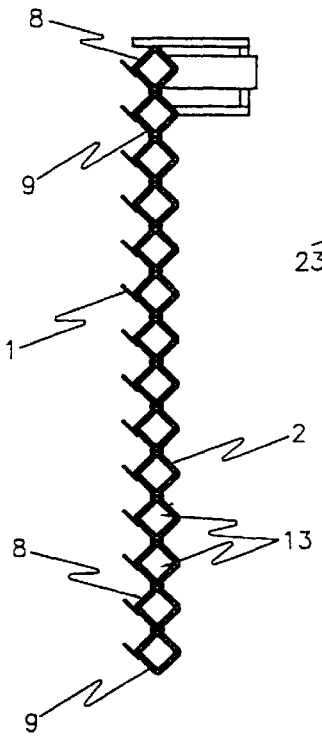
FIGS. 7*a*, 7*b*, 7*c* are respectively a front elevation, a side elevation, and a plan view of a water cooled panel in accordance with another embodiment of panel.
Figure 7A:
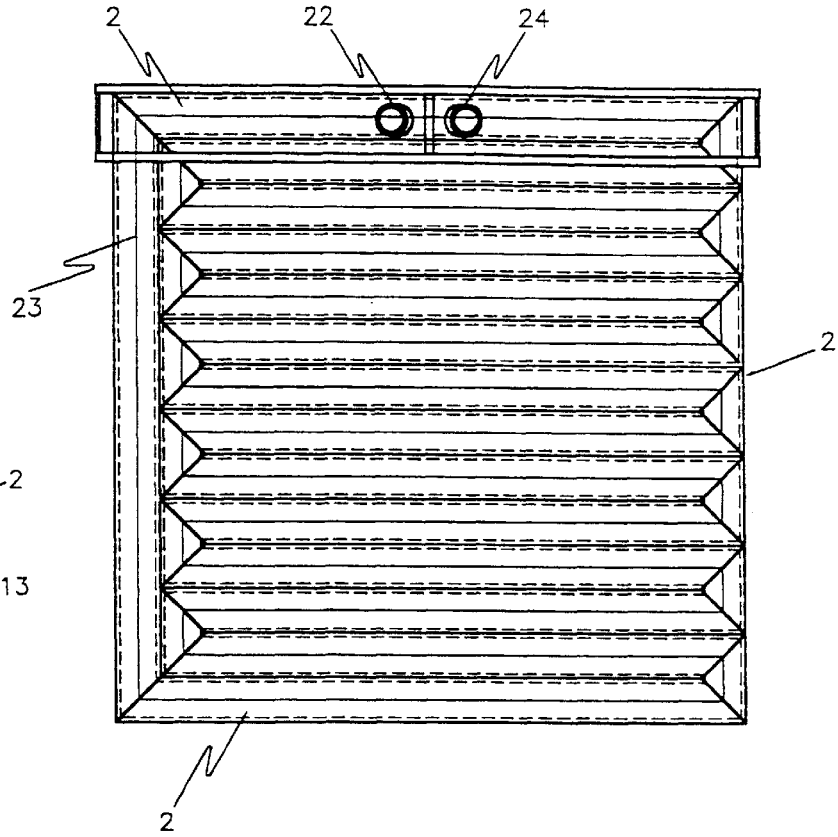
Figure 7C:
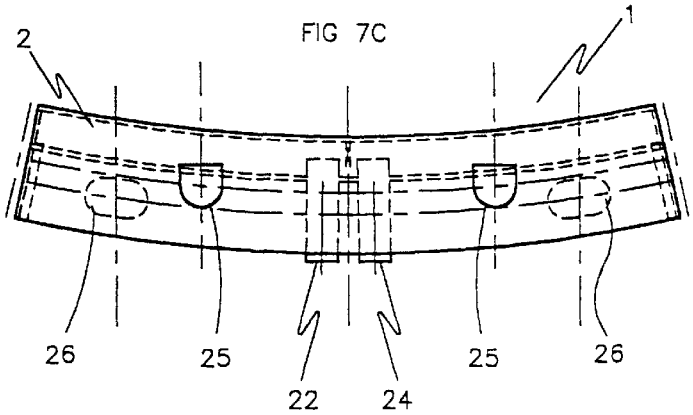

FIGS. 7*a* to 7*c* illustrate a curved panel to form part of an electric arc furnace, the curvature being apparent from FIG. 7*c*. The uppermost tube length 2 is divided into two halves with the left-hand half constituting an inlet tube half and the right-hand half constituting an outlet tube half. Thus, to the left-hand side is welded a water inlet port 22, with the left-hand side connected to a vertical water inlet tube length 23 extending to the lowermost tube length 2. The water then flows in a zig-zag path from the lowermost tube length 2 and exits into the right-hand side of the uppermost tube length 2, leaving the panel via the outlet port 24. Also illustrated are lifting legs 25 whereby the panel 1 may be craned into and out of, e.g. an electric arc furnace, and locations holes 26 whereby the panel may be correctly positioned, e.g. with respect to other components of an electric arc furnace.

What I claim is:

1. A panel adapted, in use, to be water cooled, constructed from a plurality of hollow section tube lengths of rectangular cross-section, with adjacent tube lengths oriented corner-to-corner in a diamond array with geometrical diagonals across the corners of said tube lengths in a common plane, with weld metal securing said tube lengths in such orientation by external corners of said tube lengths welded to a common backing plate, with external corners of said tube lengths welded at slots cut into said backing plate wherein, said rectangular tube lengths are formed with slag catchers adjacently connected to a 45° wall of side rectangular tube, and with means to ensure water flow communication between an end portion of one tube length and an end portion of an adjacent tube length.

2. A panel as claimed in claim 1, wherein said tube lengths are of mild steel.

3. A panel as claimed in claim 2, wherein said tube lengths are hot finished.

4. A panel as claimed in claim 1, claim 2 or claim 3, wherein at least a part of said panel is formed from tube lengths of copper.

5. A panel as claimed in claim 1, wherein a plurality of slag catchers are attached to said tube lengths at one side of said panel, which side will, in use, constitute a "hot" face of said panel.

6. A panel as claimed in claim 1, wherein the weld metal is continuous.

7. A panel as claimed in claim 1, wherein the weld metal is spaced.

8. A panel as claimed in claim 7, wherein adjacent corners of adjacent tube lengths are butted together.

9. A panel as claimed in claim 7, wherein adjacent corners of adjacent tube lengths are spaced by a relatively small gap.

10. A panel as claimed in claim 1, and intended to form part of a furnace wall, wherein said tube lengths are arranged in a parallel array.

11. A panel as claimed in claim 1, wherein said tube lengths are straight, resulting in a flat panel.

12. A panel as claimed in claim 1, of rectangular shape.

13. A panel as claimed in claim 1, provided at one side with a water inlet tube length extending orthogonally with respect to the longitudinal axes of said tube lengths.

14. A panel as claimed in claim 12, intended to constitute a furnace wall panel with horizontal tube lengths, wherein said water inlet tube length extends vertically (when said panel is assembled into a furnace), with water flow being down the inlet tube length, into a lowermost of said tube length and then in a zig-zag route through said tube lengths of said panel, until water exists from an exit port in the uppermost of said tube length.

15. A panel as claimed in claim 1, claim 2, claim 3 or claim 10, wherein at least one lifting lug is provided on said panel.

16. A panel as claimed in claim 5, wherein said slag catchers take the form of metallic stalks or plates, typically of mild steel.

17. A panel as claimed in claim 15, wherein said slag catchers are located at regularly spaced locations along each of said lengths.

18. A panel as claimed in claim 16, wherein said slag catchers of one of said tube lengths are staggered with respect to said slag catchers of an adjacent of said tube lengths.

* * * * *